US011602476B2

(12) United States Patent
Romeo et al.

(10) Patent No.: US 11,602,476 B2
(45) Date of Patent: Mar. 14, 2023

(54) PRONE PATIENT POSITIONING SYSTEM

(71) Applicant: BONE FOAM, INC., Corcoran, MN (US)

(72) Inventors: Anthony A. Romeo, Scarsdale, NY (US); Benjamin J. Watters, III, Saint Louis Park, MN (US); Clinton J. McCullough, Blaine, MN (US); Peter A. Cole, Jr., North Oaks, MN (US)

(73) Assignee: Bone Foam, Inc., Corcoran, MN (US)

( * ) Notice: Subject to any disclaimer, the term of this patent is extended or adjusted under 35 U.S.C. 154(b) by 0 days.

(21) Appl. No.: 17/348,176

(22) Filed: Jun. 15, 2021

(65) Prior Publication Data

US 2021/0386605 A1 Dec. 16, 2021

Related U.S. Application Data

(60) Provisional application No. 63/039,440, filed on Jun. 15, 2020.

(51) Int. Cl.
*A61G 13/12* (2006.01)
*A61G 13/00* (2006.01)

(52) U.S. Cl.
CPC ..... *A61G 13/121* (2013.01); *A61G 13/0054* (2016.11); *A61G 13/122* (2013.01); *A61G 2200/325* (2013.01)

(58) Field of Classification Search
CPC .. A47C 20/026; A61G 13/121; A61G 13/122; A61G 13/0054; A61G 2200/325
USPC ..... 601/24
See application file for complete search history.

(56) References Cited

U.S. PATENT DOCUMENTS 5,524,640 A * 6/1996 Lisak ..... A47D 13/08 5/655
2013/0305455 A1* 11/2013 Davis ..... A61G 13/1215 5/639

* cited by examiner

*Primary Examiner* — David R Hare
*Assistant Examiner* — Adam C Ortiz
(74) *Attorney, Agent, or Firm* — Workman Nydegger

(57) ABSTRACT

Disclosed are patient positioning systems that support a patient in the prone position. A patient positioning system includes a chest bolster and one or more head supports selectively attachable to the chest bolster. The chest bolster elevates the patient's thorax and provides for gentle cervical flexion, while the one or more head supports can be attached to the chest bolster in different configurations to support the patient in a face down position or with the head turned laterally.

20 Claims, 7 Drawing Sheets

PRONE PATIENT POSITIONING SYSTEM

CROSS-REFERENCE TO RELATED APPLICATIONS

This application claims the benefit of U.S. Provisional Application No. 63/039,440, filed Jun. 15, 2020, which is incorporated by reference in its entirety.

BACKGROUND

Positioning patients is critical for supporting body mechanics, soft-tissue risk mitigation, operating conditions, and operative-site access. Many procedures and treatments are carried out while the patient is in the prone position. In the prone position, the patient lies flat on the stomach. In some prone positioning applications, patients may be placed in positions that are not physiologic and which can lead to complications such as perioperative peripheral nerve injury (PPNI), postoperative visual loss (POVL), and cauliflower-ear.

Such patient positioning complications can result in significant patient disability, functional loss, and/or cosmetic abnormality. Patient body habitus varies greatly from patient to patient, and although different positioning indications and surgical approaches have general positions that are used, each patient has unique positioning needs to provide the ideal outcome to enhance body mechanics, soft-tissue risk mitigation, operating conditions, and/or operative-site access.

The prone position is also widely used for enhanced lung mechanics over relatively long periods of time for numerous lung conditions such as COVID-19, pneumonia, and Acute Respiratory Distress Syndrome (ARDS). The prone position may also be utilized for surgeries such as microlumbar discectomy (MLD), posterior lumbar fusion (PLF), posterior lumbar interbody fusion (PLIF), and transforaminal lumbar interbody fusion (TLIF), to name a few.

Because the prone position is widely used, there are many positioning devices on the market and they are common in operating rooms. However, such conventional prone positioning systems often rely on pillows, rolled up towels, or other makeshift components to get the patient in the desired position. In many instances, because the patient will be positioned for an extended period of time, the patient is susceptible to pressure injuries. Further, in applications when the patient's head is turned laterally, there is risk of cauliflower ear and risk of obstruction of endotracheal tubes. Risks of current prone positioning techniques include loss of visualization of the patient's face, pressure sores, obstruction of endotracheal tube or other oral leads, and loss of IV access.

Accordingly, there remains an ongoing need for improved patient positioning systems. In particular, there is an ongoing need for patient positioning systems capable of supporting a patient in the prone position for extended periods of time while reducing the risk of positioning-related injuries.

SUMMARY

Disclosed are patient positioning systems that support a patient in the prone position. A patient positioning system includes a chest bolster and one or more head supports selectively attachable to the chest bolster. The chest bolster elevates the patient's thorax and provides for gentle cervical flexion, while the one or more head supports can be attached to the chest bolster in different configurations to support the patient in a face down position or with the head turned laterally.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

BRIEF DESCRIPTION OF THE DRAWINGS

Various objects, features, characteristics, and advantages of the invention will become apparent and more readily appreciated from the following description of the embodiments, taken in conjunction with the accompanying drawings and the appended claims, all of which form a part of this specification. In the Drawings, like reference numerals may be utilized to designate corresponding or similar parts in the various Figures, and the various elements depicted are not necessarily drawn to scale, wherein:

DETAILED DESCRIPTION

Introduction

Figure 1:
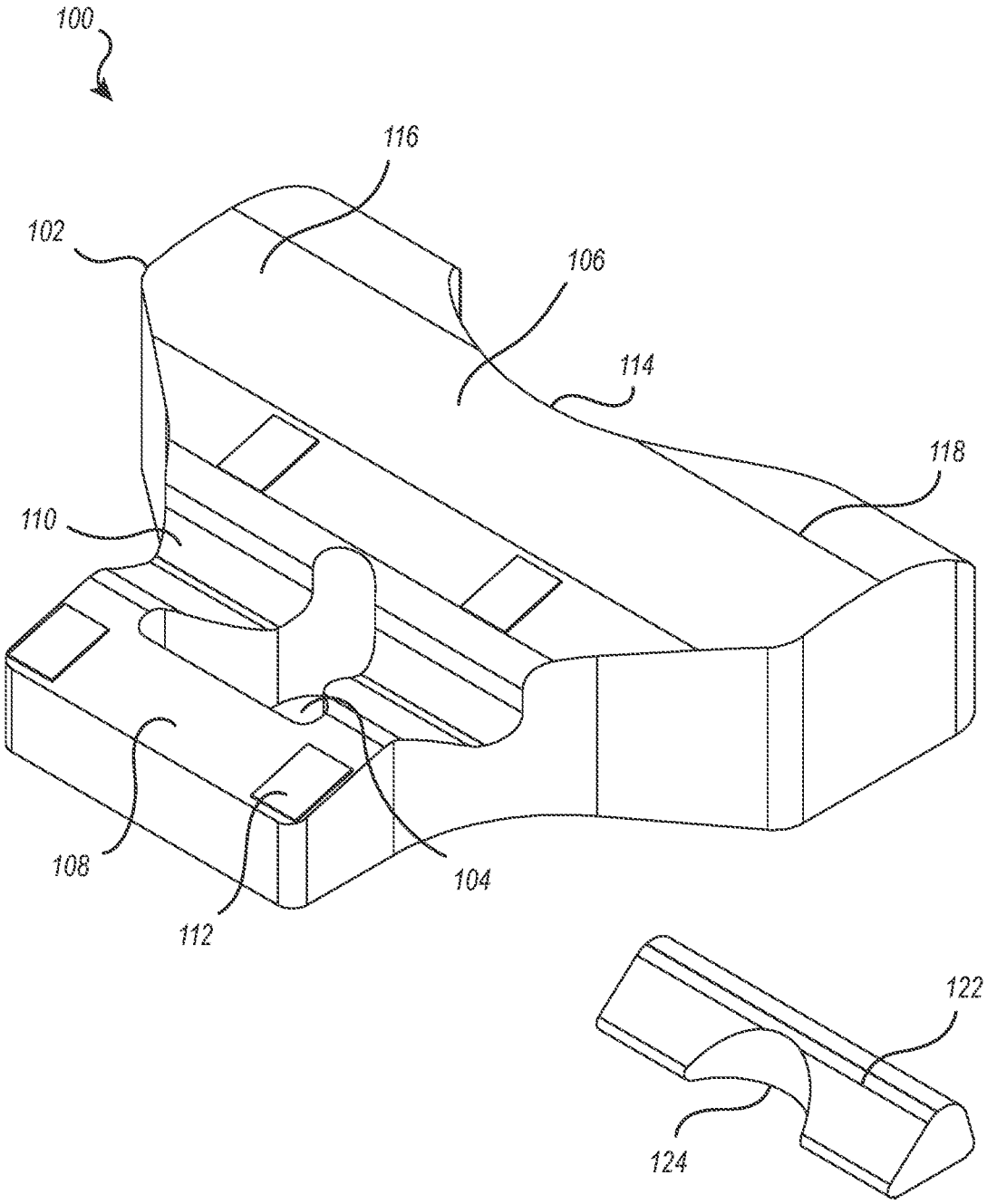
FIG. 1 illustrates an exemplary prone positioning system, including a chest bolster piece and a head support piece.

The described embodiments may be utilized in any application where it is desirable to position a patient in the prone position. The described embodiments are particularly useful in applications where a patient is expected to remain in the prone position for a relatively extended period of time, such as during procedures that last several hours or more.

One particular set of applications in which the described embodiments may be utilized is for patients suffering from serious lung conditions. Examples include COVID-19, pneumonia, ARDS, and related conditions that often require endotracheal intubation and oxygenation or ventilator support.

COVID-19 attacks the respiratory system, leading to airway inflammation and frequently progresses to ARDS with alarming regularity in elderly patients and those with pre-existing medical comorbidities. These patients often require endotracheal intubation for adequate ventilatory support in an ICU setting. Since the optimal treatments of COVID-19 are still largely unknown, intensivists are utilizing principles from the treatment of other respiratory diseases and causes of ARDS, such as positive end-expiratory pressure (PEEP) management, to prevent these patients from deteriorating and succumbing to this illness.

Positioning the ventilated patient prone has been found to improve perfusion and aeration of dorsal alveoli, enhance recruitment of lung tissue, and prevent ventilator-induced lung injury. One multicenter, randomized controlled trial demonstrated a 50% reduction in 28-day mortality using a prone positioning protocol. Ventilating a patient in the prone position requires cooperation from a multidisciplinary team to be safe and effective for the ventilated patient. The prone position, while beneficial, introduces potential complications such as loss of vascular access points, pressure ulcer formation in dependent regions, and the loss of endotracheal airway access.

Although these types of applications are highlighted, it will be understood that the prone patient positioning systems described herein may be utilized in other applications as well, such as MLD, PLF. PLIF, TLIF, other spine procedures, other orthopedic procedures, or generally any other procedure where it is useful to position the patient in a prone position.

In light of the additional description provided below, it will be apparent that the described positioning systems can provide a number of benefits. For example, embodiments can beneficially improve lateral head positioning of patients during pronation. Embodiments may also improve the prone positioning of large breasted and/or pregnant patients during procedures (e.g., spine procedures) that can thereby minimize pressure on the breasts and womb and minimize vertebral venous distension. Embodiments can beneficially protect the face, head, and anterior shoulders while in the prone position, preventing or reducing pressure injuries. In certain applications improved prone positioning, or the ability to safely leave the patient in the prone position for longer periods of time, can improve pulmonary function and mitigate ventilator induced lung injuries.

Exemplary Prone Patient Positioning System

FIG. 1 illustrates an exemplary prone positioning system 100. The positioning system 100 includes a chest bolster 102 and one or more head supports 122. The chest bolster 102 is configured to provide support to the patient's chest and head. In particular, the chest bolster 102 is shaped to elevate the thorax and to promote gentle cervical flexion. The one or more head supports 122 are preferably selectively attachable to the chest bolster 102. As explained in more detail below, this allows the system 100 to be configured in multiple different arrangements depending on whether the patient is lying face down or has the head rotated laterally in either direction.

The chest bolster 102 includes an inferior section 106 and a superior section 108. The inferior section 106 is raised higher than the superior section 108 so as to elevate the patient's thorax when positioned on the device. From an apex line 118 that runs laterally along the inferior section 106, the bolster 102 slopes downward toward its superior end. This allows for elevation of the thorax while the downward slope allows the head to be positioned slightly lower into the desired position of slight cervical flexion. The superior section 108 is preferably not as wide as the inferior section 106 to reduce obstruction and allow greater access to the patient's head.

A channel 110 runs substantially laterally and separates the inferior section 106 from the superior section 108. The channel 110 is generally aligned with where the patient's mouth would be when positioned on the device. The additional clearance provided by the channel beneficially allows increased visualization of the patient's face and enhanced access for placing intubation tubes and/or other medical equipment to the patient's face. The channel 110 also provides clearance that minimizes the risk of bending or obstructing such tubes/equipment.

Also positioned between the inferior section 106 and superior section 108 is a face aperture 104. As shown, the face aperture 104 can cross the channel 110 and be partially coincident therewith. The face aperture 104 provides clearance for the downward portions of the patient's face. For example, when the patient is face down, the face aperture 104 provides clearance for the patient's eyes, nose, and mouth. When the head is turned laterally, the face aperture provides clearance for the cheek, eye, and other parts of the downward side of the patient's head.

As shown, the face aperture 104 may be wider toward its superior side than its inferior side. This beneficially allows for greater clearance for the superior portion of the patient's face, while minimizing disruption of the structural integrity of the chest bolster 102. The narrower inferior part of the face aperture 104 also allows more of the channel 110 to be present for supporting and routing endotracheal tubing or other mouth-attached instruments. See FIG. 2, for example, which illustrates the patient head laterally turned to the right and shows that the channel 110 is able to extend laterally all the way to the patient's mouth rather than there being a gap between the mouth and the channel 110.

The illustrated chest bolster 102 also includes a thorax cutout 114 that allows a greater portion of the patient's chest to be freely elevated and unobstructed by the device, allowing the upper chest to freely fall and expand with the assistance of gravity. On either side of the thorax cutout 114 are shoulder supports 116 that extend farther inferiorly than the medially-located thorax cutout 114. The shoulder supports 116 support the anterior portion of the patient's shoulders and help position the shoulders back so that the chest can freely expand.

The illustrated chest bolster 102 includes one or more attachment elements 112 that correspond with one or more attachment elements of the head support(s) 122 (attachment elements of the head support(s) not shown in this view). This allows for selective attachment/detachment of the head support(s) 122 to the chest bolster 102. The attachment elements may comprise hook and loop fastener materials, for example, adhesives, stick surfaces, complementary friction fit features, and/or other suitable attachment means.

The illustrated head support 122 includes a cutout 124 that functions to provide clearance for different portions of the patient's head, depending on the particular configuration of the head support 122.

Figure 2:
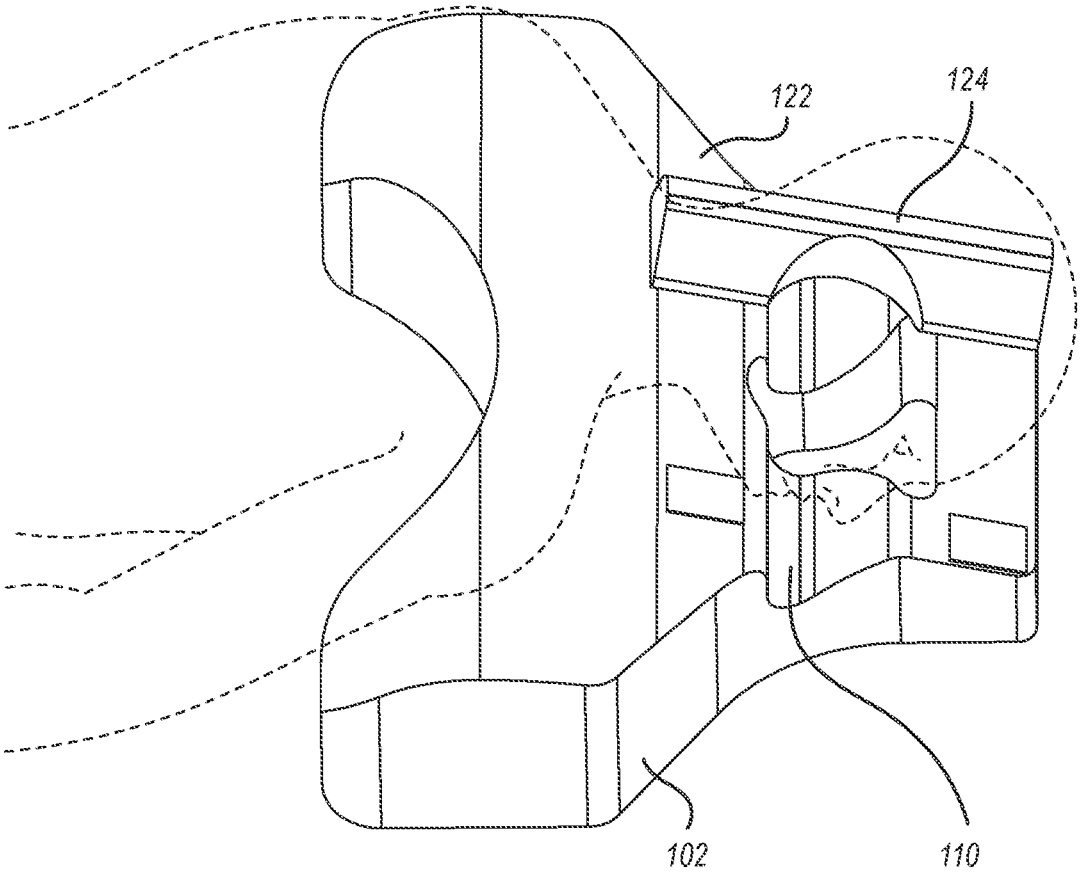
FIG. 2 illustrates an exemplary use of the prone positioning system with where a patient's head is turned laterally, showing the relative position of the head support on the chest bolster in this application.

FIG. 2 shows a patient positioned on the positioning system 100 with the head turned laterally to the patient's right. As shown, the patient's mouth and nose are generally aligned with the channel 110, which allows for effective visualization of the patient's face and good access to the mouth and nose for intubation components or other desired equipment.

In the illustrated position, a head support 122 may be positioned on the side opposite the direction the patient's head is turned. In this configuration, the head support 122 can provide comfortable support to the side of the patient's head, and can slightly elevate the head and prevent it from over-rotating. In the illustrated configuration, the cutout 124 of the head support 122 allows clearance for the patient's ear to prevent pressure sores (e.g., cauliflower ear) that often result from prolonged compression of sensitive ear tissues.

Figure 3A:
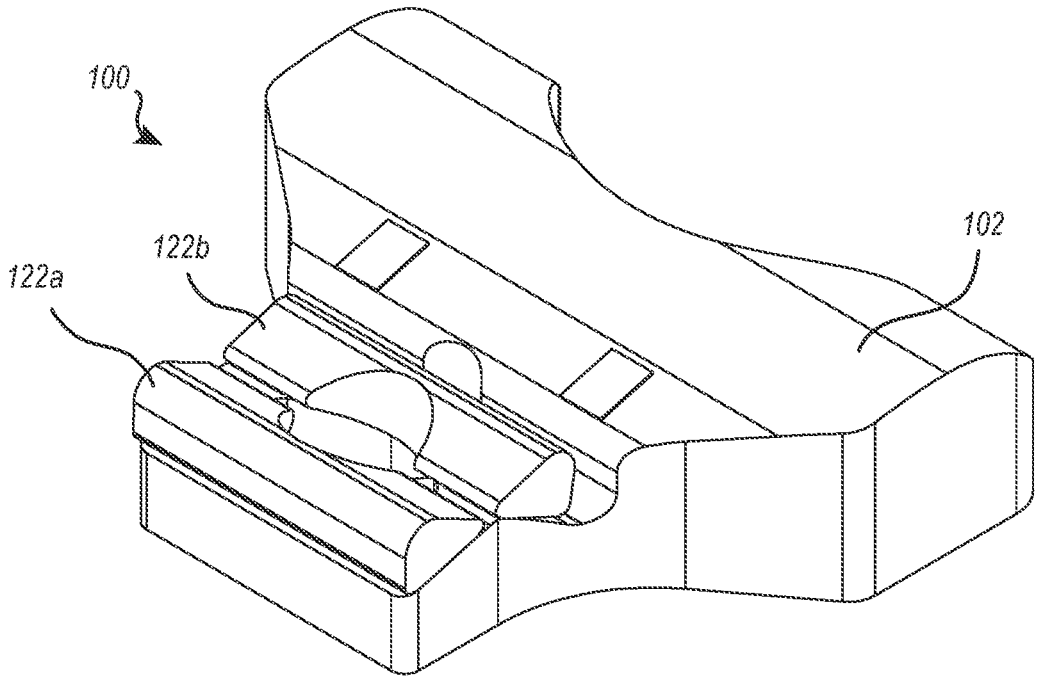
FIGS. 3A and 3B illustrate another configuration of the prone positioning system where one or two head supports may be positioned to support the forehead and/or chin of the patient in a face-down application.
Figure 3B:
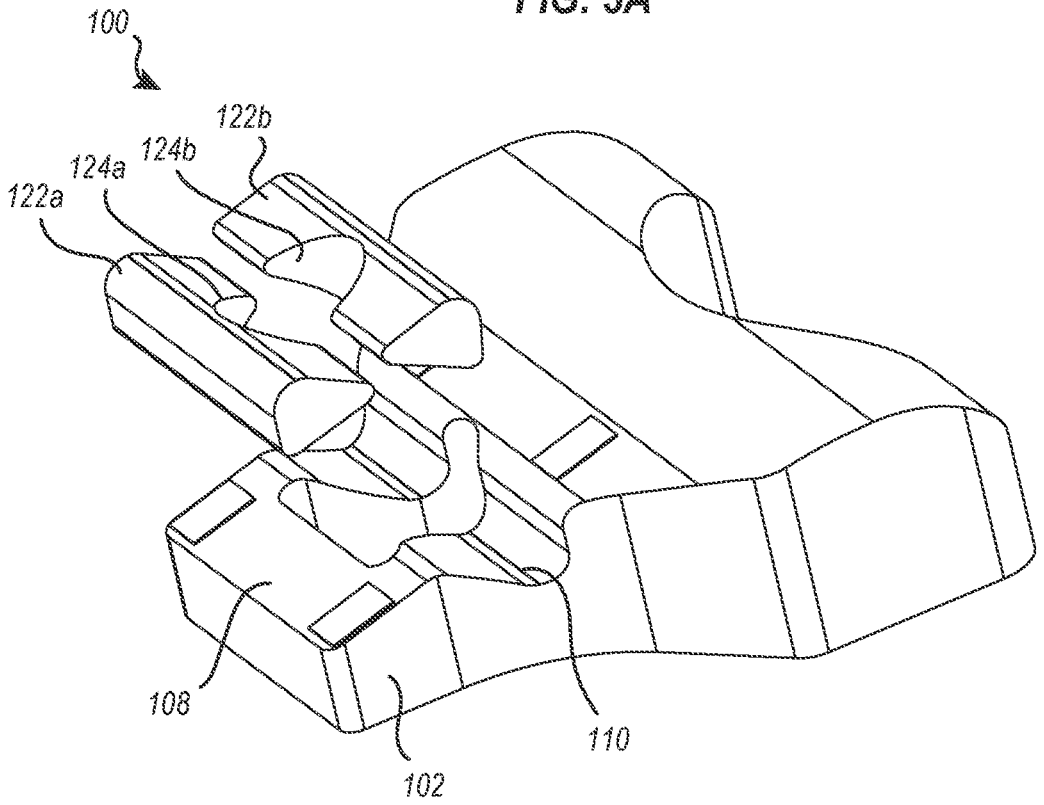
Figure 4A:
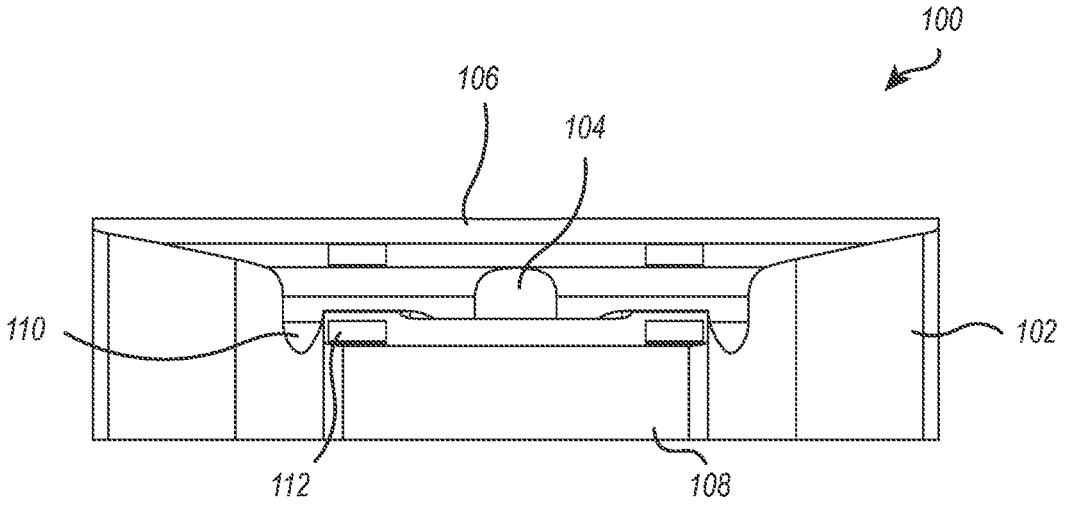
FIGS. 4A-4E illustrate additional views of the exemplary chest bolster.
Figure 4B:
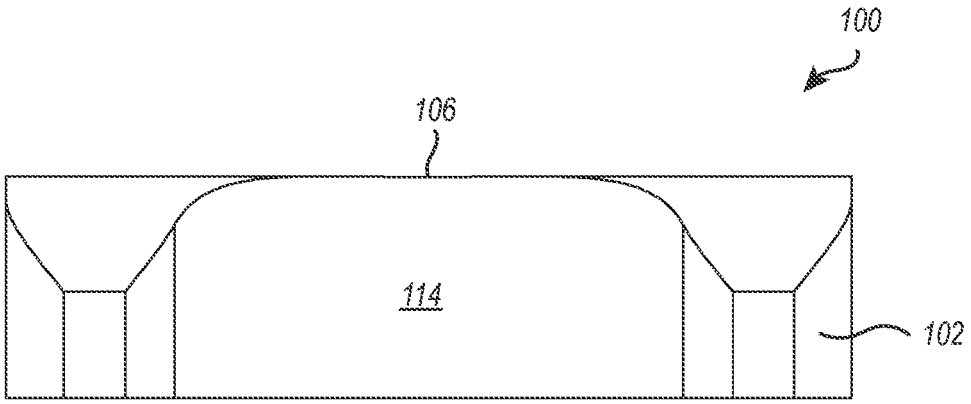
Figure 4C:
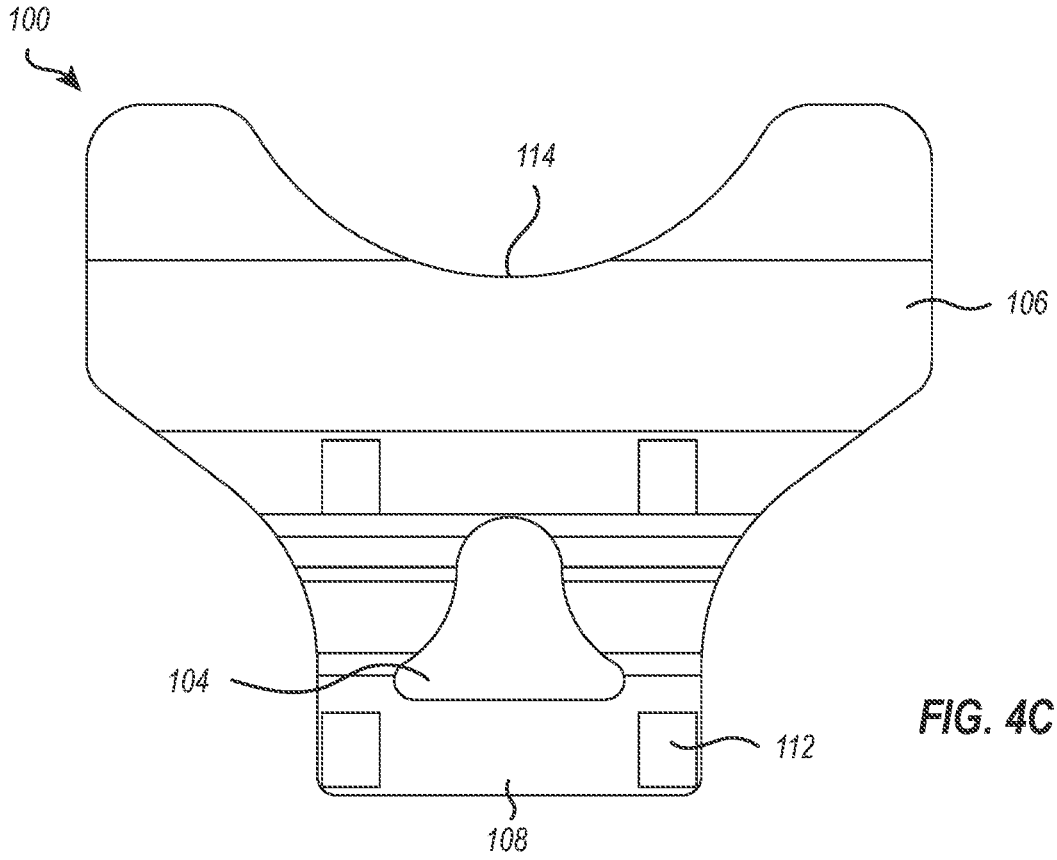
Figure 4D:
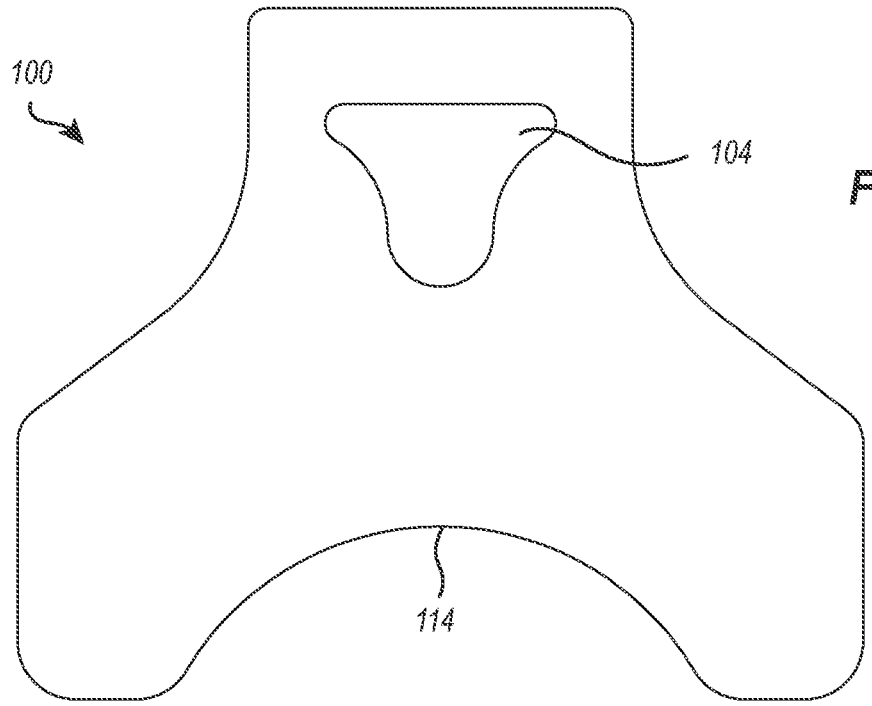
Figure 4E:
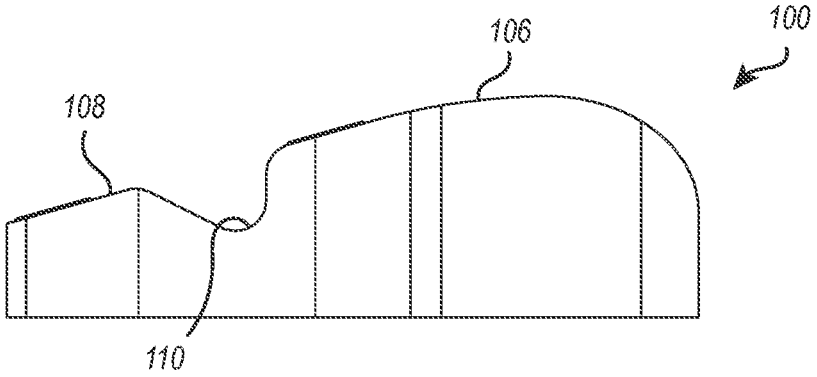
Figure 5A:
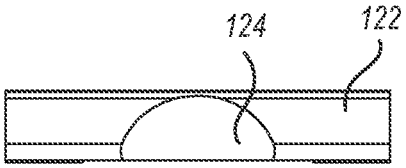
FIGS. 5A-5E illustrate additional views of the exemplary head support.
Figure 5B:
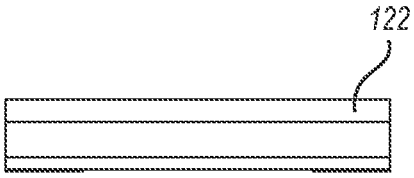
Figure 5C:
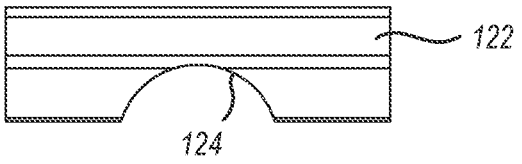
Figure 5D:
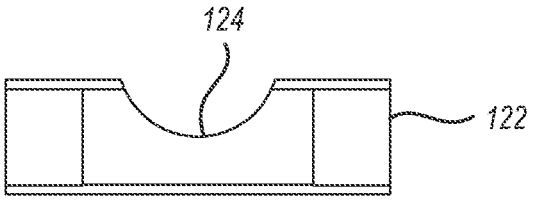
Figure 5E:
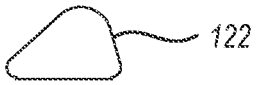

FIGS. 3A and 3B show an alternative configuration of the system 100 that may be utilized when the patient is positioned face down, for example. In this configuration, two separate head supports 122*a* and 122*b* may be utilized. Each may be substantially identical to limit the need for specialized head supports, to allow easier setup of the system, and allow more versatility and ease of switching between different system configurations.

As shown, the head supports 122*a* and 122*b* may be positioned to extend along a medial-lateral direction rather than an inferior-superior direction. The bottom surface of a first head support 122*a* may be attached to an upper surface of the superior section 108 of the chest bolster 102. Additionally, or alternatively, a second head support 122*b* may be positioned within the channel 110. When the patient is in the face down position, the first head support 122*a* can provide additional support to the forehead, while the second head support 122*b* can provide additional support to the chin. The cutouts 124*a* and 124*b* align with each other and with the underlying face aperture 104 to provide desired clearance for the patient's face.

The cross-sectional shape of the illustrated head support 122*b* is configured to substantially match the shape of the channel 110 so that it can readily position within the channel 110. As shown, the head support 122*b* may have a wedge-shaped cross-section, though other embodiments may utilize other shapes for the head support and/or channel 110.

FIGS. 4A-4E illustrate additional views of the exemplary chest bolster 102, and FIGS. 5A-5E illustrate additional views of the exemplary head support 122. While the particular dimensions of these components may vary according to particular application needs, a chest bolster suitable for a typical application (e.g., for average-sized adult) can have a length (in an inferior-superior direction) of about 15 to about 18 inches, a width (in a medial-lateral direction) of about 18 to about 26 inches at its widest at the inferior section, a width of about 8 to about 12 inches at the superior section, and a height of about 4 to about 8 inches at the apex line. The slope from the apex line in the superior direction may be at about 15 to about 35 degrees.

Each head support can be sized to function with the chest bolster. A head support may have, for example, a length of about 8 to about 12 inches, a width of about 1.5 to about 3.5 inches, and a height of about 2.5 to about 4.5 inches.

The chest bolster and the head support(s) are preferably formed from a foam material. The foam material preferably has a 25% indentation load deflection (ILD) of about 10 to about 90, more preferably about 15 to about 60, even more preferably about 20 to about 45. Foam that is too soft does not adequately support the patient, whereas foam that is too rigid may not adequately cushion and protect from pressure injuries. Foam within the foregoing ranges has been found to beneficially balance patient cushioning with patient support.

CONCLUSION

While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component may generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, or less than 1% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") may also include two or more such referents.

It will also be appreciated that embodiments described herein may include properties, features (e.g., ingredients, components, members, elements, parts, and/or portions) described in other embodiments described herein. Accordingly, the various features of a given embodiment can be combined with and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include such features.

The invention claimed is:

1. A patient positioning system configured to position a patient in a prone position, the system comprising:

a chest bolster shaped to elevate the patient's thorax when the patient is positioned thereon, wherein the chest bolster includes a channel extending substantially laterally across the chest bolster and extending completely across a width of the chest bolster from a first lateral side to a second lateral side of the chest bolster;

wherein the chest bolster further includes a face aperture to provide clearance for a downward portion of the patient's face when the patient is positioned thereon;

one or more head supports configured to support a portion of the patient's head wherein the one or more head supports are configured in size and shape to removably fit within the channel.

2. The system of claim 1, wherein the chest bolster is shaped to promote cervical flexion of the patient.

3. The system of claim 1, wherein the one or more head supports are selectively attachable to the chest bolster.

4. The system of claim 1, wherein the chest bolster includes an inferior section and a superior section, the inferior section being raised higher than the superior section.

5. The system of claim 1, wherein the face aperture is wider at a superior side than at an inferior side.

6. The system of claim 1, wherein the chest bolster further includes a thorax cutout.

7. The system of claim 6, wherein the chest bolster further includes shoulder supports on each side of the thorax cutout to support the anterior side of the patient's shoulders.

8. The system of claim 7, wherein the shoulder supports extend farther inferiorly than the thorax cutout.

9. The system of claim 1, wherein the one or more head supports each comprise a cutout.

10. The system of claim 1, wherein the one or more head supports are positionable to extend along an inferior-superior direction and to support a back portion of the patient's head when the patient's head is turned laterally.

11. The system of claim 1, wherein the one or more head supports are positionable to extend along a medial-lateral direction and to support one or both of the patient's forehead or patient's chin when the patient is facing downward.

12. A method of positioning a patient in the prone position, the method comprising:

providing a patient positioning system as in claim 1; and positioning a patient in the prone position thereon.

13. A patient positioning system configured to position the patient in a prone position, the system comprising:

a chest bolster shaped to elevate the patient's thorax, wherein the chest bolster includes an inferior section and a superior section, the inferior section being raised higher than the superior section to promote cervical flexion of the patient when the patient is positioned thereon, the chest bolster including a face aperture to provide clearance for a downward portion of the patient's face when the patient is positioned thereon, wherein the chest bolster includes a channel extending substantially laterally across the chest bolster and extending completely across a width of the chest bolster from a first lateral side to a second lateral side of the chest bolster; and one or more head supports configured to support a portion of the patient's head, the one or more head supports being removably attachable to the chest bolster within the channel.

14. The system of claim 13, wherein the face aperture is wider at a superior side than at an inferior side.

15. The system of claim 13, wherein the chest bolster further includes a thorax cutout.

16. The system of claim 15, wherein the chest bolster further includes shoulder supports on each side of the thorax cutout to support the anterior side of the patient's shoulders.

17. The system of claim 16, wherein the shoulder supports extend farther inferiorly than the thorax cutout.

18. The system of claim 13, wherein the one or more head supports each comprise a cutout.

19. The system of claim 13, wherein the one or more head supports are positionable to extend along an inferior-superior direction and to support a back portion of the patient's head when the patient's head is turned laterally.

20. The system of claim 13, wherein the one or more head supports are positionable to extend along a medial-lateral direction and to support one or both of the patient's forehead or patient's chin when the patient is facing downward.

* * * * *